US007448127B2

(12) United States Patent
Tokura

(10) Patent No.: US 7,448,127 B2
(45) Date of Patent: Nov. 11, 2008

(54) TUBE EXPANDER FOR HEAT EXCHANGER

(75) Inventor: Kenji Tokura, Osaka (JP)

(73) Assignee: Kyoshin Kogyo Co., Ltd., Osaka (JP)

( * ) Notice: Subject to any disclaimer, the term of this patent is extended or adjusted under 35 U.S.C. 154(b) by 711 days.

(21) Appl. No.: 10/494,352

(22) PCT Filed: Apr. 8, 2002

(86) PCT No.: PCT/JP02/03508

§ 371 (c)(1),
(2), (4) Date: Dec. 30, 2004

(87) PCT Pub. No.: WO03/047786

PCT Pub. Date: Jun. 12, 2003

(65) Prior Publication Data

US 2005/0115061 A1 Jun. 2, 2005

(30) Foreign Application Priority Data

Dec. 7, 2001 (JP) ..... 2001-402529

(51) Int. Cl.
*B23P 15/26* (2006.01)
*B21D 39/08* (2006.01)

(52) U.S. Cl. ..... 29/726; 29/726.5; 29/727; 29/890.044

(58) Field of Classification Search ..... 29/726, 29/726.5, 727, 890.044
See application file for complete search history.

(56) References Cited

U.S. PATENT DOCUMENTS

| | | | | |
|---|---|---|---|---|
| 3,688,533 | A * | 9/1972 | Ames | 72/20.2 |
| 4,597,171 | A * | 7/1986 | Kitayama et al. | 29/727 |
| 5,220,722 | A * | 6/1993 | Milliman | 29/727 |
| 5,353,496 | A | 10/1994 | Harman et al. | |
| 5,432,994 | A | 7/1995 | Tokura | |
| 5,806,173 | A | 9/1998 | Honma et al. | |
| 5,815,913 | A | 10/1998 | Tokura | |
| 6,176,006 | B1 * | 1/2001 | Milliman et al. | 29/727 |

FOREIGN PATENT DOCUMENTS

JP 08-099141 4/1996

* cited by examiner

*Primary Examiner*—David P Bryant
*Assistant Examiner*—Alexander P Taousakis
(74) *Attorney, Agent, or Firm*—Muramatsu & Associates

(57) ABSTRACT

A tube expander for heat exchangers is capable of organizing an ideal production line where the transportation efficiency is increased and the productivity is improved by having a transportation path in a straight line through which the heat exchangers are carried into one end and carried out from the other end. Left and right ends of an end plate at the front side are inserted by a pair of first guide bars, and the left and right ends at the back side are inserted by a pair of second guide bars. A guide path for a carrying device or a transportation device is established on a base that supports the first guide bars and the second guide bars in a clearance between the first guide bars and support columns. The heat exchangers are transported from one end to the other of the base via the guide path.

7 Claims, 2 Drawing Sheets

TUBE EXPANDER FOR HEAT EXCHANGER

FIELD OF THE INVENTION

The present invention relates to a tube expander for expanding tubes for producing a heat exchanger, and more particularly, to a tube expander for expanding a plurality of tubes inserted in multi-layers of heat dissipation fins to integrally attaching the tubes to the heat dissipation fins by pressing mandrels into the tubes.

BACKGROUND OF THE INVENTION

Figure 2:
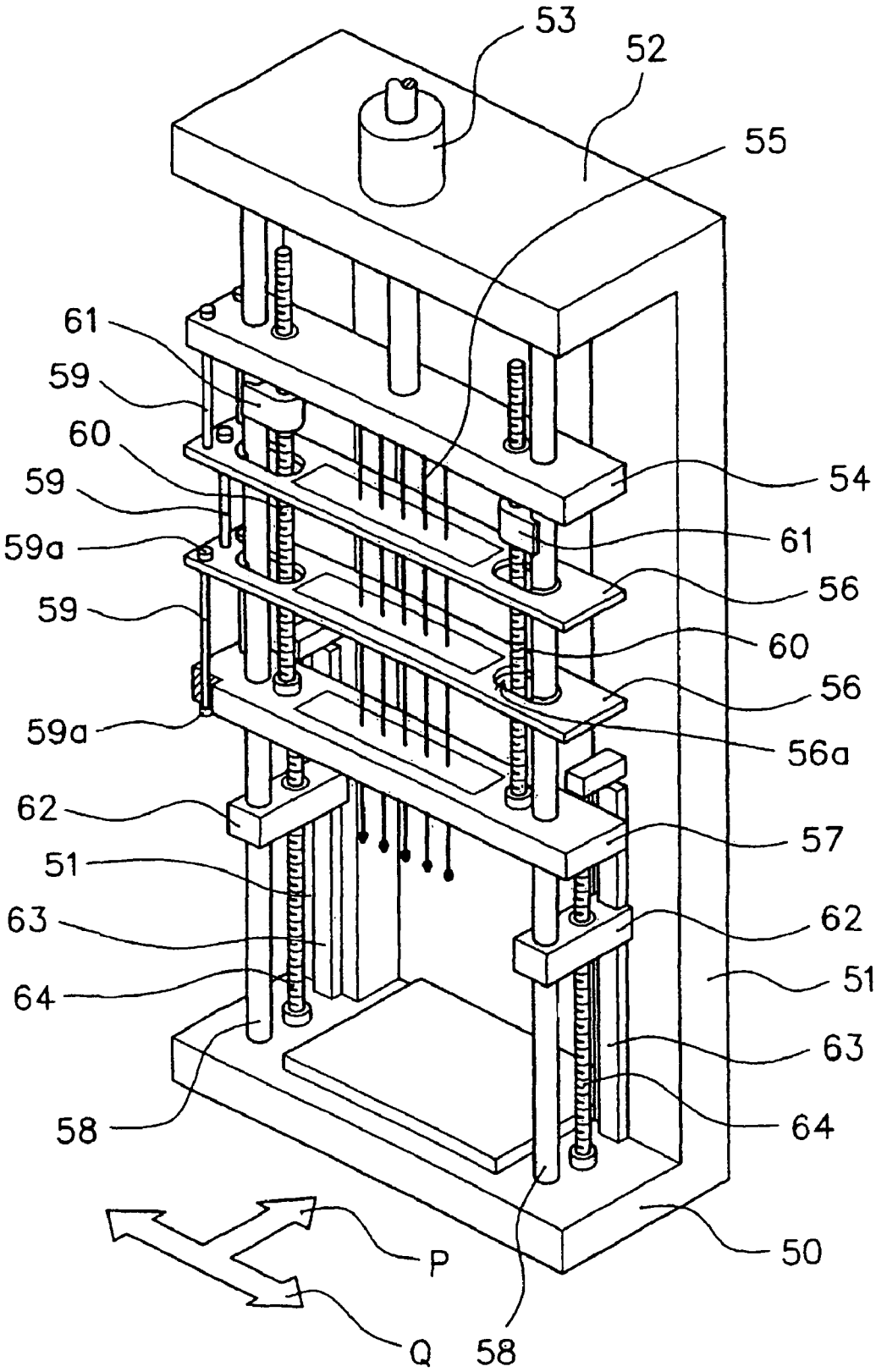

Traditionally, as shown in FIG. 2, a tube expander for expanding tubes used for a heat exchanger has a structure that includes a ceiling 52 mounted on top of a pair of support columns 51 that are vertically affixed to a base 50, a cylinder 53 that is attached to the ceiling 52, and an operation plate 54 assembled with a plurality of tube expansion mandrels 55 that are vertically movable for expanding the tubes by expansion and contraction movements of the cylinder 53.

Since each tube expansion mandrel 55 is formed in the shape of a rod with a relatively small diameter and a sufficient length to fit-in the diameter and length of each tube of the heat exchanger (not shown) positioned on the base 50, the tube expansion mandrels 55 need to be supported at proper locations to restrict any flexures in horizontal directions during the press-fitting operation.

Therefore, in order to restrict such flexures of the mandrels, the tube expander further has a plurality of guide plates 56 that are located under the operation plate 54. Each of the guide plates 56 has a plurality of through holes for the tube expansion mandrels 55 to pass therethrough. The tube expander further includes tubular strippers (not shown) on the bottom side of the lowest guide plate 56 (the side facing the base 50) that fit over the tubes protruding from the surface of the heat exchanger (not shown) and press the surface down to adjust the length of the tubes, and an end plate 57 also consisting of a plurality of through holes for the tube expansion mandrels 55 to pass therethrough.

Further, at each left end and right end of the operation plate 54, the guide plate 56 and the end plate 57, a pair of guide bars 58 affixed between the base 50 and the ceiling 52 are inserted therethrough at the centers in the front and back direction. Thus, the operation plate 54, the guide plate 56, and the end plate 57 are able to vertically move along the guide bars 58 while maintaining a parallel relationship with each other.

Further, hang bolts 59 (not shown on the right side of drawing) are inserted in the operation plate 54, the guide plate 56, and the end plate 57, respectively. By the engagement of heads 59*a* attached to both ends of each hang bolt 59 which prevent the hang bolt 59 from falling out, the maximum distance between the operation plate 54, the guide plate 56, and the end plate 57 is determined.

Further, in the operation plate 54, the guide plate 56, and the end plate 57, a pair of ball screws 60 parallel to the guide bars 58 are inserted therethrough, where the bottom ends thereof are movably supported by the end plate 57.

On each of the ball screws 60, an upper stopper 61 is rotatably attached thereto, and on each of the upper stoppers 61, a half-sized arc that contacts with a half of the cylindrical arc of the guide bar 58 (guide post) is formed. Thus, when the ball screw 60 is rotated by a drive unit such as a motor (not shown), the half-sized arc slides along the guide bar 58 while the upper stopper 61 itself moves in an up-and-down direction along the ball screw 60.

The upper stopper 61 is able to contact the bottom surface of the operation plate 54 upon passing through a long hole 56*a* formed on the guide plate 56.

Further, between the base 50 and the end plate 57, lower stoppers 62 are established for adjusting the length of the tubes projecting from the end surface of the heat exchanger by restricting the downward movement of the end plate 57.

On the front side of each of the lower stoppers 62, the guide bar 58 is inserted therein, and the rear side thereof is slidably attached to the guide rail 63 which is fixedly formed on the column 51.

Further, between the guide bar 58 and the guide rail 63, the lower stopper 62 is rotatably attached therein, and a bottom end of a ball screw 64 which is parallel to the guide bar 58 and the guide rail 63 for vertical movement is rotatably supported on the base 50.

Therefore, when the ball screw 64 for vertically moving the lower stopper 62 rotates by a drive unit such as a motor (not shown), the lower stopper 62 smoothly moves in an up-and-down direction through the guide bar 58 and the guide rail 63 without sway.

The lower stopper 62 formed in the structure noted above can restrict (stop) the downward movement of the end plate 57 by contacting with the bottom surface of end the plate 57 that moves downwardly along with the operation plate 54 when the cylinder 53 is extended.

However, in the tube expander having the above noted conventional structure, the left and right ends of the operation plate 54, the guide plate 56, and the end plate 57 are inserted with a pair of guide bars 58 at about the centers in the front and back direction and are slidably supported by the guide bars 58.

In other words, in order to smoothly move each of the above noted plates along the guide bars 58 while maintaining a parallel relationship with one another, the guide bars 58 must be inserted through the centers (with respect to the front and back direction of the tube expander) of each of the plates.

Consequently, the guide bars 58 inevitably block the left and right sides of the base 50, and since various oil pressure units and control boards (not shown) are usually installed on the back side of the tube expander, the heat exchanger can only be transported in and out of the front side (arrow P) of the tube expander during the tube expansion operation.

As a result, when organizing a production line of the heat exchanger to improve the productivity, the transportation of the heat exchanger into the tube expander or out of the tube expander to another location or toward another device must be conducted in the left and right direction (arrow Q). However, due to the reason noted above, a reciprocable point has to be formed on the transportation path (reciprocating transportation path), thus, creating various problems such as a lower transportation efficiency as well as a need for a special transportation mechanism for that reciprocable point, which increases the production cost for the tube expander.

SUMMARY OF THE INVENTION

Therefore, the present invention has been made to solve the above noted problems involved in the conventional technology. In the present invention, an end plate is able to vertically slide by a support mechanism made of first guide bars which are established on the front side at the left and right corners and second guide bars which are established on the rear side at left and right corners. The end plate maintains a parallel state while smoothly moving along the first guide bars and the second guide bars without creating any twists or flexures on the end plate.

Four corners of the end plate are slidably supported by the first and second guide bars, and under the end plate, a stopper 19 is slidably provided to either the first guide bars 10 or the second guide bars 11 through a stopper up/down means formed close to the first guide bars 11 or the columns 3 or the second guide bars. Under the end plate, in the clearance created at the base between the first guide bars and the columns, it is possible to establish either a guide path for a carrying device for transporting the heat exchangers or a guide path for installing a transportation device such as a conveyor for transferring the heat exchangers from one end of the base to another end of the base.

Therefore, the various guide paths noted above work as transportation paths for the heat exchanger, thereby enabling to create the transportation path of a straight line. Namely, it is possible to transport the heat exchangers from one side of the tube expander (in the left and right direction) to the opposite side of the tube expander, that is, the other end of the tube expander (through-the-center method). Thus, it is an object of the present invention to provide a tube expander used for heat exchangers which is capable of organizing an ideal production line where the efficiency of transferring the heat exchangers is increased, thereby improving the productivity of the heat exchangers.

To solve the above noted problems, the tube expander of the present invention for expanding tubes for use in a heat exchanger is configured by a system frame 1 comprising a base 2, a ceiling 4, and support columns 3 that join the back ends of the base 2 and the ceiling 4. The tube expander is provided with a vertically movable operation plate 6 established with a plurality of mandrels 7 for expanding the tubes between the base 2 and the ceiling 4, as well as an end plate 9 suspended under the operation plate 6 where it is restricted from falling by a stopper 19 positioned at the same height as the heat exchanger to be set on the base 2. A pair of first support members 12 are provided at both right and left ends of the end plate 9 to mount the end plate in such a way that the front side of the end plate 9 is slidably attached to a pair of first guide bars 10 which are formed between the base 2 and the ceiling 4. Further, a pair of second support members 13 are provided at both right and left ends of the end plate 9 to mount the end plate in such a way that the back side of the end plate 9 is slidably attached to a pair of second guide bars 11 which are formed between the base 2 and the ceiling 4. Further, the stopper 19 is slidably provided to either the first guide bars 10 or the second guide bars 11 through a stopper up/down means formed close to the first guide bars 11 or the support columns 3 or the second guide bars. As a result of the above configuration, the clearance created at the base 2 establishes either a guide path 2*a* for a carrying device 23 for carrying the heat exchangers or a guide path 2*a* for installing a transportation device mechanism for transferring the heat exchangers from one end of the base 2 to another end of the base between the first guide bars 10 and the support columns 3.

Accordingly, the four corners on the end plate 9, that is, the left and right ends of the end plate 9 at the front side slide along the first guide bars 10 and the left and right ends of the end plate 9 at the back side slide along the second guide bars 11 so that the end plate can maintain a steady and level state while smoothly moving in an up-and-down direction without any twists or flexures.

Therefore, a plurality of tubular strippers (not shown) mounted on the bottom of the end plate 9 (the side facing the base) can accurately cover the individual tubes projecting from the end surface of the heat exchanger (not shown).

Further, a spatial path for transporting the heat exchanger from one end of the tube expander to other end (opposite end) in the left and right direction can be securely created under the end plate 9 which is slidably supported by the first and second guide bars for vertical movements, namely, in the clearance within the distance between the first guide bars 10 and the support columns 3 between the end plate 9 and the base 2.

Consequently, with use of the clearance created at the base 2, it is possible to establish either a guide path 2*a* for a carrying device 23 for carrying the heat exchangers or a guide path 2*a* for installing a transportation device for transferring the heat exchangers from one end of the base 2 to another end of the base between the first guide bars 10 and the second guide bars 11.

Therefore, the various guide paths noted above work as transportation paths for the heat exchanger, thereby creating the transportation path of a straight line. Namely, it is possible to transport the heat exchangers from one side of the tube expander (in the left and right direction) to the opposite side of the tube expander, that is, the other end (namely, through-the-center method). Thus, the present invention has an advantage that is able to provide a tube expander for heat exchangers which is capable of organizing an ideal production line where the efficiency of transferring the heat exchangers is increased, thereby improving the productivity of the heat exchangers.

Further, in the case where the stopper up/down means is ball screws 20 rotatably attached to the stoppers 19, by forming the ball screws 20 close to the second guide bar 11 or the support column 3 or the first guide bar, it is possible to prevent various members for the up/down movement of the stopper 19 from entering in the path created between the first guide bars and the support columns 3, thereby enabling to use the guide path 2*a* of maximum capacity.

Further, in the case where the second guide bar 11 is structured as a rail mounted on the support column 3, the end plate 9 can smoothly move in an up-and-down direction in a steady condition without needs to use expensive cylindrical guide posts as the second guide bars 11. Moreover, since the rail which is less expensive than the guide post with the support column 3 yet is able to acquire the same strength as that of the cylindrical guide post is used, any flexures arising on the rail from the end plate 9 can be prevented by such strengths acquired by the support column 3.

Further, a fixing device 24 for positioning the carrying device 23 that holds and carries the heat exchangers from one end of the base 2 to the other end and fixing the carrying device to an appropriate location on the base for the tube expansion operation is mounted on either the carrying device 23 or the base 2. Thus, the transportation path where the heat exchangers are transported from the one end of the base 2 to the other end of the base 2 is formed in a straight line. Accordingly, the heat exchangers are sequentially carried into the tube expander, and the heat exchangers can be stopped at the precise location for the tube expansion operation regardless of the background of the worker such as his years of experience. Thus, it is possible to establish an automated production line for the heat exchangers.

Further, the fixing device 24 can be mounted either on the base 2 or on the carrying device 23. The fixing device 24 can position the heat exchanger moving from the one end of the base 2 toward the other end of the base 2 by the carrying device at a location for the tube expansion operation and fix the heat exchanger at the location. Since the transportation path for the heat exchangers is formed in a straight line and the heat exchangers are sequentially carried into the tube expander, the heat exchanger can be stopped at the precise location for the tube expansion operation regardless of the background of the worker such as his years of experience. Further, it is also possible to establish an automated production line for heat exchangers.

Further, the fixing device 24 can be mounted either on the base 2 or on the transportation device. The fixing device 24 can position the heat exchanger moving from the one end of the base 2 toward the other end of the base 2 at a location for the tube expansion operation and fix the heat exchanger at the location. Since the transportation path for the heat exchangers is formed in a straight line and the heat exchangers are sequentially carried into the tube expander, the heat exchanger can be stopped at the precise location for the tube expansion operation regardless of the background of the worker such as his years of experience. Further, it is also possible to establish an automated production line for heat exchangers.

Further, the fixing device 24 can be mounted either on the base 2 or on the transportation device. The fixing device 24 can position the heat exchanger moving from the one end of the base 2 toward the other end of the base 2 at a location for the tube expansion operation and fix the transportation device at the location. Since the transportation path for the heat exchangers is formed in a straight line and the heat exchangers are sequentially carried into the tube expander, the heat exchanger can be stopped at the precise location for the tube expansion operation regardless of the background of the worker such as his years of experience. Further, it is also possible to establish an automated production line for heat exchangers.

BRIEF DESCRIPTION OF THE INVENTION

Figure 1:
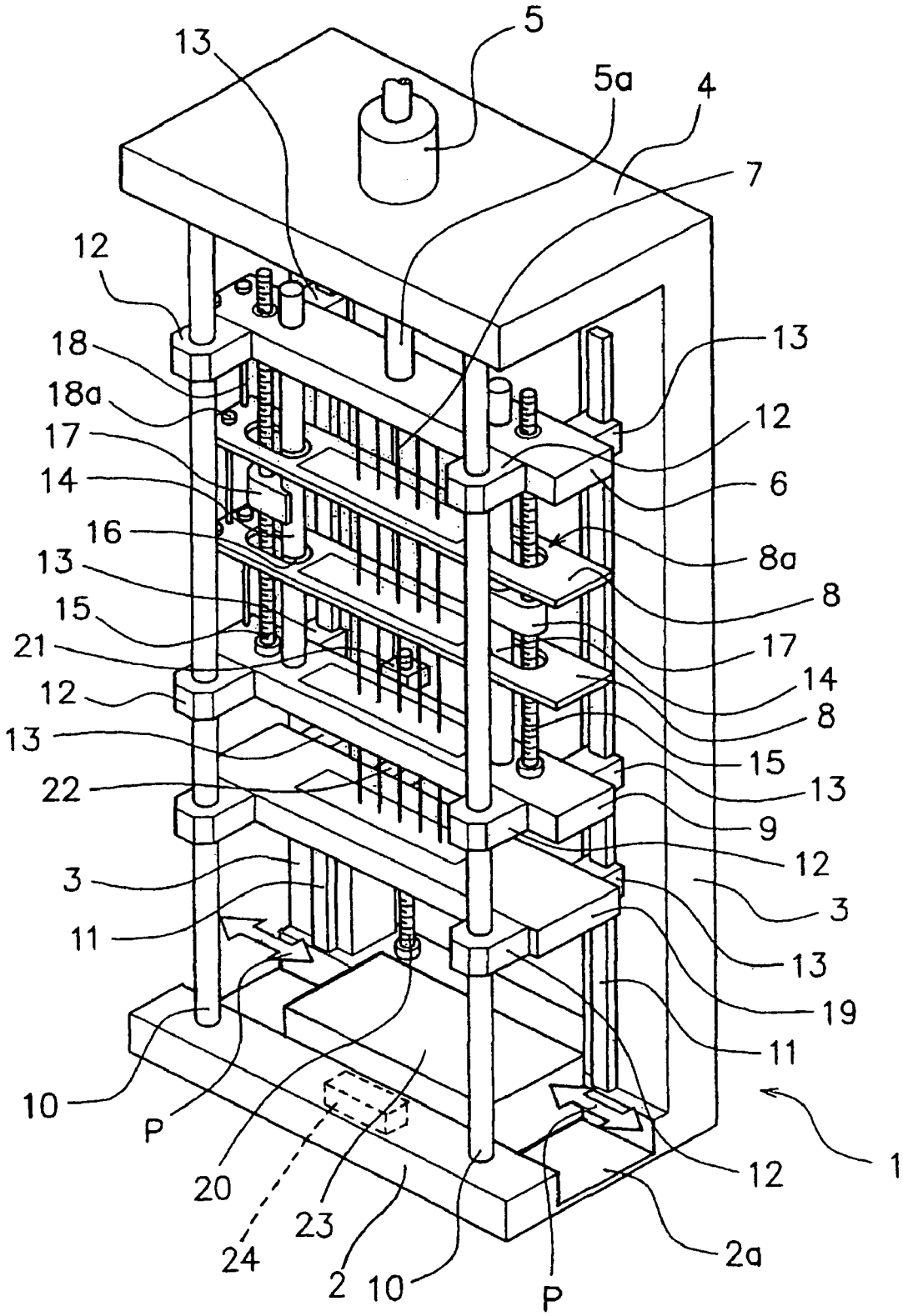

FIG. 1 is a perspective view showing an overall structure of the preferred embodiment of the tube expander for expanding tubes for use with exchangers in the present invention, and FIG. 2 is a perspective view showing an overall structure of the conventional tube expander for expanding tubes for use with heat exchangers.

PREFERRED EMBODIMENT IMPLEMENTING THE INVENTION

In order to disclose the present invention in more detail, description will be made with reference to the attached drawings.

FIG. 1 illustrates an overall structure of the tube expander of the present invention, where a ceiling 4 is mounted on top of a pair of support columns 3 that are vertically affixed on the left and right back end of a base 2, where a system frame 1 is structured by the base 2, the support columns 3 and the ceiling 4.

On the ceiling 4, a cylinder 5 equipped with a cylinder rod 5*a* that comes out from the bottom of the ceiling 4 towards the base 2 is attached.

At the end of the cylinder rod 5*a*, a rectangular operation plate 6 is affixed at about the center thereof, where the operation plate 6 is vertically movable through the extension and contraction movement of the cylinder rod 5*a* of the cylinder 5.

Further, on the bottom side of the operation plate 6, a plurality of mandrels 7 for tube expansion are suspended therefrom. Thus, when the operation plate 6 moves up and down, the tube expansion mandrels 7 move up and down accordingly.

Each of the tube expansion mandrels 7 is formed in the shape of a rod with a diameter and a length that to fit the diameter and length of each tube on the heat exchanger (not shown). Thus, the tube expansion mandrels 7 need to be supported in the appropriate locations to prevent flexures in the horizontal direction from arising during the press-fitting in the tubes.

Accordingly, in the lower side of the operation plate 6, a plurality of guide plates 8 are formed. Further, an end plate 9 is installed at the bottom end of the guide plates, where the tube expansion mandrels 7 are inserted through the guide plates 8 and the end plate 9 in a vertically movable manner.

Further, on the left and right ends of the system frame 1, at the front side, a pair of first guide bars 10 are mounted thereon.

The above noted first guide bars 10 are cylindrical guide posts that join the ceiling 4 and the base 2, where the top ends thereof are supported by the front side (corners) of the ceiling 4, and the bottom ends thereof are supported by the front side (corners) of the base 2.

Further, on the left and right ends of the system frame 1, at the back side, a pair of second guide bars 11 are mounted thereon.

The above noted second guide bars 11 are rails respectively affixed to the left and right support columns 3 in an up-and-down direction, where the top ends thereof are located close to the back end (corners) of the ceiling 4, and the bottom ends are located close to the back end (corners) of the base 2.

On the left and right ends of the operation plate 6, at the front side, the pair of first guide bars 10 are inserted therethrough. On the left and right ends of the operation plate 6, at the back side, the pair of second guide bars 11 are inserted therethrough. Thus, each guide bar 10 and 11 can maintain a horizontal plane of the end plate 6 when moving up and down.

More specifically, on the front side of the operation plate 6 at the left and right ends thereof, a pair of first support members 12 are mounted for allowing the operation plate 6 to slide along the first guide bars 10 by being inserted with the first guide bars 10. On the left and right ends of operation plate 6 at the back side, a pair of second support members 13 are mounted for allowing the operation plate 6 to slide along the second guide bars 11 by being inserted with the second guide bars 11.

In the above embodiment, brackets are used for the above mentioned first support members 12, and sliders are used for the second support members 13.

Then, similar to the operation plate 6, on the left and right ends of the end plate 9 at the front side, the pair of first guide bars 10 are inserted therethrough. On the left and right ends of the end plate 9 at the back side, the pair of second guide bars 11 are attached for allowing the end plate 9 to move up and down while maintaining a horizontal plane.

More specifically, on the left and right ends of the end plate 9 at the front side, the pair of first support members 12 are mounted for allowing the end plate 9 to slide along the first guide bars 10 by being inserted with said guide bars 10. On the left and right ends of the end plate 9 at the back side, the pair of second support members 13 are mounted for allowing the end plate 9 to slide along the second guide bars 11 by being inserted with the second guide bars 11.

With respect to the above mentioned end plate 9, brackets are used for the first support members 12, and sliders are used for the second support members 13. However, so long as these support members can support the operation plate 6 and the end plate 9 in a manner to keep the horizontal plane while smoothly sliding up and down along the first guide bars 10 and the second guide bars 11, it is unnecessary to limit to such specific structures and components for each of the first support members 12 and the second support member 13.

The guide plates 8 provided between the operation plate 6 and the end plate 9 are a plurality of boards that are properly suspended at predetermined distances corresponding to the length of the tube expansion mandrels 7.

Since the guide plates 8 determine the maximum distance between the operation plate 6 and the end plate 9 by adjusting their number, it is not always necessary to be engaged with the first guide bars 10 and the second guide bars 11. Therefore, the first support members 12 and the second support members 13 would not exist with respect to the guide plates 8, thereby allowing the front end of each guide plate 8 to be placed away from the first guide bars 10.

Moreover, on the left and right ends of each guide plate 8, long holes 8*a* are formed, where a third guide bar 14 (rod-like guide post) as well as a first ball screw 15 are inserted in each of the long holes 8*a* and 8*a*.

The top ends of the above mentioned third guide bars 14 are inserted through the left and right ends of the operation plate 6 to move up and down, and the bottom ends thereof are held on the left and right ends of the end plate 9, thereby being in parallel with the first guide bars 10.

In addition, at each of the long holes 8a of the guide plate 8, a semi-circular slider 16 contacting with a half of the cylindrical arc on the third guide bar 14 is provided thereon, where the slider 16 slides along the third guide bar 14 so that each guide plate 8 maintains a horizontal plane while moving up and down.

The top ends of the first ball screws 15 are inserted through the left and right holes of the operation plate 6 to be vertically movable, and the bottom ends are held on the left and right ends of the end plate 9 in a rotatable manner, thereby being in parallel with the third guide bars 14.

Further, at each of the first ball screws 15, an upper stopper 17 is rotatably attached thereto.

On the upper stopper 17, a half arc portion that contacts with a half of the cylindrical arc of the third guide bar 14 is formed, and when the first ball screw 15 is rotated through a drive unit such as a motor (not shown), the half arc portion slides along the third guide bar 14 while the upper stopper 17 moves up and down through the first ball screw 15.

The upper stopper 17 is able to pass through the long hole 8*a* formed on the guide plate 8 and contacts the bottom surface of the operation plate 6.

Since the first ball screw 15 is placed outer side than the third guide bar 14 (although the third guide bar 14 and the first ball screw 15 can be positioned vice versa), the slider 16 can slide along the inner half of the cylindrical arc on the third guide bar 14, and the upper stopper 17 can slide along the outer half of the cylindrical arc on the third guide bar 14, thus, the slider 16 and the upper stopper 17 do not interfere with each other.

Therefore, as explained above, on the operation plate 6, the guide plate 8 and the end plate 9, the first guide bars 10 and the third guide bars 14 are inserted therethrough, where the operation plate 6, the guide plate 8 and the end plate 9 maintain the parallel relationship with one another while moving vertically along the first guide bars 10 and the third guide bars 14.

On each of the operation plate 6, the guide plate 8 and the end plate 9, a hang bolt 18 (not shown on the right side of the diagram) is inserted therethrough, where each of the plates 6, 8 and 9 are held by heads 18*a* mounted at both ends of the hang bolt 18 so that the plates will not fall out, and by the numbers of the hang bolts 18 and the guide plate 8, the maximum distance between the operation plate 6 and the end plate 9 is determined.

In addition, between the base 2 and the end plate 9, a plate-like lower stopper 19 (reference plate) is mounted for restricting (stopping) the downward movement of the end plate 9 by contacting with the bottom surface of the end plate 9 that is descending along the operation plate 6 which descends by the operation of the cylinder 5. As shown, the stopper 19 is a single plate that is designed to contact with an overall bottom surface of the end plate 9 when preventing the end plate 9 from further moving down.

Similar to the end plate 9, at the front side, the front left and right ends of the stopper 19 are inserted with the pair of first guide bars 10, and at the back side, the left and right ends are attached to the pair of second guide bars 11 in a slidable manner, thereby allowing the stopper 19 to maintain a horizontal plane while moving up and down.

More specifically, on the left and right ends of the stopper 19 at the front side, the pair of first support members 12 are mounted for allowing the stopper 19 to slide along the first guide bars 10 by being inserted with said first guide bars 10. On the left and right ends of the stopper 19 at the back side, the pair of second support members 13 are mounted for allowing the stopper 19 to slide along the second guide bars 11 by being inserted with the second guide bars 11.

Further, on the back side of the stopper 19, a pair of second ball screws 20 are provided to allow the stopper 19 to move up and down.

The top ends of the second ball screws 20 are held in a rotatable manner by a pair of retainers 21 established on an inner surface of the tube expander where the support columns 3 face one another, and the bottom ends of the second ball screws 20 are held in a rotatable manner on the left and right ends of the base 2 at the back side to be parallel with the first guide bars 10 close to the support column 3 and along the support column 3.

Further, the left and right ends of the stopper 19 at the back side are respectively screwed onto the pair of second ball screws 20.

More specifically, on the left and right ends of the stopper 19 at the back side, a pair of female screws 22 where the second ball screws 20 are screwed thereon are mounted. Thus, when each of the second ball screws 20 is rotated through the drive unit such as a motor (not shown but is provided within the base 2), the stopper 19 can maintain a horizontal plane while moving up and down along the first and second guide bars 10 and 11.

Further, on the base 2, a guide path 2*a* for a carrying device 23 which carries the heat exchangers is established in the clearance created between the first guide bars 10 and the second guide bars 11 where the heat exchangers can pass there through from one end of the base 2 to the other end of the base 2 (arrow P).

Further, on the base 2, a fixing device 24 for fixedly positioning the carrying device 23 at a position on the base 2 for conducting the tube expansion operation is provided where the carrying device 23 moves from one end of the tube expander to the other end of the tube expander in a left and right direction.

As for the structure of the above mentioned fixing device 24, for example, the fixing device 24 may have a lock pin (not shown) that can be inserted in an indent (not shown) formed on the carrying device 23 when the carrying device 23 is transported to an appropriate location for the tube expansion operation of the heat exchanger. Alternatively, the fixing device 24 may have a pressure member (not shown) for pushing the carrying device 23 to the predetermined location on the base 2. Further alternatively, the fixing device 24 may have a plurality of clamping members (not shown) that can clamp the carrying device 23 transported to the tube expansion location in the front and back direction or in the left and right direction (the transporting direction of the carrying device 23) to be accurately positioned on the base 2. In other words, the structure of the fixing device 24 is not limited to a specific example but can take any form.

In the operation of the tube expander configured as in the foregoing, first, the stopper 19 is positioned at the desired height by rotating each of the second ball screws 20 so that the tube expander accommodates the height dimension of the heat exchangers.

Moreover, at this point, the upper stoppers 17 are positioned at the desired location by rotating each of the first ball screws 15 to accommodate the height dimension of the heat exchangers.

According to the tube expander having the above mentioned structure, a spatial path for transporting the heat exchangers from one end of the tube expander (in the left and right direction) to the opposite end (the other end) of the tube expander is created between the first guide bars 10 and the second guide bars 11 as well as between the end plate 9 and the base 2 located on both ends of the tube expander (in the left and right direction). Further, a guide path 2*a* for utilizing the spatial path to transport the heat exchangers by the carrying device 23 is established in the clearance between the first guide bars 10 and the support columns 3.

Further, on the base 2, the fixing device 24 is provided for positioning the carrying device 23 that transports the heat exchangers from one end of the base 2 to the other end of the base through the guide path 2*a* at an appropriate location on the base where the tube expansion operation is conducted.

Since the transportation path for allowing the heat exchangers to pass through one end of the base 2 to the other of the base 2 is formed in a straight line and the heat exchangers are sequentially carried into the tube expander, each of the heat exchangers can be stopped at the precise location for the tube expansion operation regardless of the background of the worker such as his years of experience, where an automated production line of the heat exchanger can be organized.

Next, after positioning the carrying device 23 that runs from one end of the base 2 toward the other of the base at the location for the tube expansion location on the base 2 by the fixing device 24, the cylinder 5 is operated. Then, the operation plate 6, the guide plate 8, and the end plate 9 respectively move downwardly in accordance with the extension of cylinder rod 5*a* while maintaining the distance between each other.

When contacting the stopper 19, the end plate 9 is restricted any further descending movement, and then, the guide plate 8 is restricted any further descending movement by contacting the end plate 9.

Since the four corners on of the end plate 9, that is, the left and right ends at the front side slide along the first guide bars 10 and the left and right ends at the back side slide along the second guide bars 11, twists or flexures will not occur on the end plate 9, thereby steadily maintaining the horizontal plane while the end plate 9 is smoothly moving up and down.

Therefore, the plurality of tubular strippers (not shown) mounted on the bottom surface of the end plate 9 (base side) can precisely cover the corresponding tubes projecting from the surface of the heat exchanger. Further, because the end of the strippers press down the surface of the heat exchanger at a predetermined dimension, it is possible to adjust the length of the tubes.

As a result, it is possible to avoid the collision between the strippers and the tubes that may arise in such a case where the twist or flexure occurs on the end plate 9.

After the above mentioned strippers pressed down the surface of the heat exchanger and adjusted the length of the protruding tubes, the tube expansion mandrels 7 are pressfitted into the tubes of the heat exchanger to integrally connect the heat dissipation fins and the tubes. When the tip of each of the tube expansion mandrels 7 (tube expanding billet) arrives near the bottom of the heat exchanger, the operation plate 6 contacts the upper stopper 17 so that its downward movement is restricted.

At this point, the tube expansion process is finished, where the cylinder rod 5*a* is extracted and the tube expansion mandrels 7 are pulled back from the tubes of the heat exchanger.

Then, the completed heat exchanger is transported out from the base 2 (arrow P) by the carrying device 23.

As a result, according to the tube expander of the present embodiment, the transportation path for the heat exchangers is formed in the straight line to allow the heat exchangers to pass there through from one end of the base 2 and to the other end of the base 2 (arrow P). Thus, the tube expander is able to creating an ideal production line, which increases the transportation efficiency and improves the productivity of the heat exchangers.

In the above mentioned embodiment, the guide path 2*a* for the carrying devices 23 for transporting the heat exchangers is established on the base 2 by utilizing the spatial path formed in the clearance between the first guide bars 10 and the support columns 3. However, the heat exchangers do not have to be transported through such a guide path 2*a* for the carrying devices 23, but, for example, a guide path 2*a* can be used to install a transportation device formed with various conveyors separately from the tube expander, or a guide path 2*a* can be used where transportation devices of various structures are directly installed on the base 2 to allow the heat exchanger to pass there through from one end of the base 2 and to the other. Namely, either case where the guide path 2*a* is used for the carrying devices 23 or the guide path 2*a* is used to readily install the transportation device, the heat exchangers are transported from the one end of the base 2 to the other end of the base 2, the guide path 2*a* can be established in the clearance between the first guide bars 10 and the support columns 3.

In the above embodiment, the stopper up/down means is implemented by the ball screw 20 in which the ball screw 20 is provided close to the support column 3 in parallel therewith. However, it is not always necessary to position the ball screw 20 close to the support column 3. For example, the ball screw 20 can be formed close to the second guide bar 11 or the first guide bar 10 in parallel with the second guide bar 11 or the first guide bar. Even in such a configuration, it is possible to prevent various members for the up/down movement of the stopper 19 from entering in the path created between the first guide bars and the support columns 3, thereby enabling to use the guide path 2*a* of maximum capacity.

Further, in the case where the second guide bars 11 are structured by rails mounted on the support column 3, the end plate 9 can smoothly move in an up-and-down direction in a steady condition without needs to use expensive cylindrical guide posts as the second guide bars 11. Moreover, since the rails are used which are less expensive than the guide posts with the support column 3 yet is able to acquire the same strength as that of the cylindrical guide post, any flexures arising on the rails from the end plate 9 in the reciprocal movements can be prevented by such strengths acquired by the support column 3.

Further, in the above mentioned embodiment, the top ends of the second ball screws 20 are held in a rotatable manner by the pair of retainers 21 on the inner wall of the tube expander where the support columns face one another, and the bottom ends of the second ball screws 20 are held in a rotatable manner on the left and right ends of the base 2 at the back side so that they are parallel to the first guide bars 10. In this configuration, the second guide bars 11 and the second ball screws 20 do not have to be in line with one another on the tube expander with respect to the front and back direction, allowing the width dimension of the tube expander in this direction to be as small as possible.

Further, in the above mentioned embodiment, the fixing device 24 for positioning the carrying device 23 at an appropriate position on the base 2 for the tube expansion operation is mounted on the base 2. However, alternatively, the fixing device 24 can be mounted on the carrying device 23.

Further, the fixing device 24 can have a structure to position the heat exchanger moving from the one end of the base 2 toward the other end through the carrying device 23 at an appropriate position and fix the heat exchanger at the position for the tube expansion operation. In either case, since the transportation path for the heat exchangers is formed in a straight line and the heat exchangers are sequentially carried into the tube expander, the heat exchanger can be stopped at the precise location for the tube expansion operation regardless of the background of the worker such as his years of experience. Further, it is also possible to establish an automated production line for heat exchangers.

Further, the fixing device 24 has a structure to be mounted either on the base 2 or on the carrying device. The fixing device 24 can position the heat exchanger moving from the one end of the base 2 toward the other end of the base 2 by the carrying device at a location for the tube expansion operation and fix the heat exchanger or the carrying device at the location. Since the transportation path for the heat exchangers is formed in a straight line and the heat exchangers are sequentially carried into the tube expander, the heat exchanger can be stopped at the precise location for the tube expansion operation regardless of the background of the worker such as his years of experience. Further, it is also possible to establish an automated production line for heat exchangers.

The present invention is not limited to the above mentioned embodiments, and various modifications are possible without departing from the intended scope of the present invention.

For example, the first support members 12 and the second support members 13 can be integrally provided on the operation plate 6, the end plate 9 and the stopper 19, respectively, or separate support members can be provided to each of the plates.

Further, although the brackets and sliders are used for the first support columns 12 and the second support columns 13, it is unnecessary to limit to such specific structures for achieving the same functions.

The diameter, length, shape, and number of tube expansion mandrels 7, as well as the number of guide plates 8, the number of cylinders 5, the shape of the upper stopper 17, and the shape of the semi-circular arc bearing (slider) 16 are not limited to specific example described above.

Further, although the cylindrical guide posts are used for the first guide bars 10 and the third guide bars 14, it is unnecessary to limit the shape of the guide bars to the cylindrical shape.

In the above mentioned embodiment, the tube expander is a vertical type, however, it is apparent that the present invention is not limited to such a type and can be applied to a horizontal type as well when the horizontal type tube expander has the same structure, where in this case, the horizontal tube expander is so constructed that the support columns are parallel to the ground.

Further, the tube expander of the present invention for heat exchanger includes the pair of first support members that are provided at both right and left ends of the end plate to mount the end plate in such a way that the front side of the end plate is slidably attached to the pair of first guide bars which are formed between the base and the ceiling, and a pair of second support members that are provided at both right and left ends of the end plate to mount the end plate in such a way that the back side of the end plate is slidably attached to the pair of second guide bars 11 which are formed between the base 2 and the ceiling. Further, the stopper is slidably provided to either the first guide bars or the second guide bars through the stopper up/down means formed close to the first guide bars or the support columns or the second guide bars. As a result of the above configuration, the clearance created at the base establishes either the guide path for the carrying device for carrying the heat exchangers or the guide path for installing the transportation device for transferring the heat exchangers from one end of the base to another end of the base between the first guide bars and the support columns.

In the tube expander of the present invention for heat exchanger, either the guide path for the carrying device for carrying the heat exchangers or the guide path installed with a transportation device for transporting the heat exchangers can be established on the base in the clearance created between the first guide bars and the proximity with the second guide bars 11 or the ball screws 20 provided close to the columns 3 for the vertical movement of the stopper 19 so that the heat exchangers pass there through from the one end of the base and toward the other end.

Therefore, the spatial path can be established in the clearance between the first guide bars and the support columns for allowing the heat exchangers to be carried into from the end of the tube expander (in the left and right direction) and carried out from the opposite end (the other end) while smoothly moving the end plate in the up-and-down direction with steady condition.

As a result, the guiding path for the carrying device for carrying the heat exchangers or the guide path ready to install the transportation device can be established on the base by utilizing the spatial path, and the transportation path that allows the heat exchangers to pass through from the one end of the base to the other end is formed in a straight line. Accordingly, the tube expander of the present invention for use with the heat exchangers is capable of establishing an ideal production line which improves the transportation efficiency and the productivity.

INDUSTRIAL APPLICABILITY

As explained above, in the tube expander of the present invention for use with the heat exchanger, the transportation path for the heat exchangers is formed in a straight line, that is, the method in which the heat exchangers are introduced from one end of the tube expander (in the left and right direction) and carried out from the opposite end, that is, the other end (in other words, through-the-center method) can be achieved, which increases the transportation efficiency and improves the productivity.

What is claimed is:

1. A tube expander for heat exchangers comprising:

a system frame formed with a base, a ceiling, and support columns for connecting back ends of the base and the ceiling;

a vertically movable operation plate having a plurality of tube expansion mandrels located between the base and the ceiling;

an end plate suspended under the operation plate where the end plate is restricted from descending by contacting a stopper positioned at a vertical position corresponding to the heat exchanger to be set on the base;

a pair of first support members that are provided at both right and left ends of the end plate to mount the end plate in such a way that a front side of the end plate is slidably attached to a pair of first guide bars which are formed at a front side of the tube expander;

a pair of second support members that are provided at both right and left ends of the end plate to mount the end plate in such a way that a back side of the end plate is slidably attached to a pair of second guide bars which are formed at a back side of the tube expander; and wherein the stopper is designed to contact with an overall bottom surface of the end plate when stopping the end plate and is slidably supported by the first guide bars and the second guide bars and is moved by a stopper up/down means formed close to the support columns;

whereby a guide path is established on the base between the first guide bars and the support columns wherein the guide path extends between a right end and a left end of the base for a carrying device to carry the heat exchangers or for installing a transportation device for transferring the heat exchangers.

2. A tube expander for heat exchangers as defined in claim 1, wherein said stopper up/down means is a ball screw rotatably attached to the stopper and is formed closed to the first guide bars, support columns, or the second guide bars.

3. A tube expander for heat exchangers as defined in claim 1, wherein said second guide bars are rails mounted on said support columns.

4. A tube expander for heat exchangers as defined in claim 1, wherein a fixing device for positioning the carrying device for carrying the heat exchanger from one end to other end of the base and fixing the carrying device at a position for a tube expansion operation on the base is mounted on either the carrying device or the base.

5. A tube expander for heat exchangers as defined in claim 1, wherein a fixing device for positioning the heat exchanger carried by the carrying device from one end to other end of the base and fixing the heat exchanger at a position for a tube expansion operation on the base is mounted on either the carrying device or the base.

6. A tube expander for heat exchangers as defined in claim 1, wherein a fixing device for positioning the heat exchanger transferred by the transportation device from one end to other end of the base and fixing the heat exchanger at a position for a tube expansion operation on the base is mounted on either the base or the transportation device.

7. A tube expander for heat exchangers as defined in claim 1, wherein a fixing device for positioning the heat exchanger transferred by the transportation device from one end to other end of the base and fixing the carrying device to position the heat exchanger at a position for a tube expansion operation on the base is mounted on either the base or the transportation device.

* * * * *